US007854587B2

(12) United States Patent
Ito et al.

(10) Patent No.: US 7,854,587 B2
(45) Date of Patent: Dec. 21, 2010

(54) CENTRIFUGAL COMPRESSOR AND DRY GAS SEAL SYSTEM FOR USE IN IT

(75) Inventors: Toshio Ito, Ushiku (JP); Hiroshi Yamada, Kasumigaura (JP)

(73) Assignee: Hitachi Plant Technologies, Ltd., Tokyo (JP)

( * ) Notice: Subject to any disclaimer, the term of this patent is extended or adjusted under 35 U.S.C. 154(b) by 635 days.

(21) Appl. No.: 11/635,551

(22) Filed: Dec. 8, 2006

(65) Prior Publication Data

US 2007/0147988 A1 Jun. 28, 2007

(30) Foreign Application Priority Data

Dec. 28, 2005 (JP) ..... 2005-376855

(51) Int. Cl.
*F01D 11/06* (2006.01)
*F04D 29/08* (2006.01)

(52) U.S. Cl. ..... 415/168.2

(58) Field of Classification Search ..... 415/168.1, 415/168.2, 168.4, 169.1, 169.2, 170.1
See application file for complete search history.

(56) References Cited

U.S. PATENT DOCUMENTS 5,412,977 A * 5/1995 Schmohl et al. ..... 73/46
6,345,954 B1 * 2/2002 Al-Himyary et al. ..... 415/112
6,524,059 B1 2/2003 Nogiwa
6,708,981 B2 * 3/2004 Hall et al. ..... 277/431
6,802,689 B2 10/2004 Nogiwa

FOREIGN PATENT DOCUMENTS

| | | |
|---|---|---|
| EP | 1 137 887 B1 | 5/2003 |
| JP | 5-10454 A | 1/1993 |
| JP | 9-60734 A | 3/1997 |
| JP | 11-182690 A | 7/1999 |
| WO | WO 01/07791 A1 | 2/2001 |

* cited by examiner

*Primary Examiner*—Edward Look
*Assistant Examiner*—Sean J Younger
(74) *Attorney, Agent, or Firm*—Crowell & Moring LLP

(57) ABSTRACT

The present invention relates to a centrifugal compressor using a dry gas seal system for protecting seal means. A multistage centrifugal compressor has primary dry gas seal means for preventing leakage of working gas from a machine inner side, and secondary dry gas seal means for backing up the first dry gas seal means. A seal gas line for introducing the gas leaked from the first and second dry gas seal means to the outside of the machine is installed between the primary dry gas seal means and the secondary dry gas seal means. The gas seal line has an orifice and a check valve, and buffer means is installed between the orifice and the check valve.

4 Claims, 2 Drawing Sheets

CENTRIFUGAL COMPRESSOR AND DRY GAS SEAL SYSTEM FOR USE IN IT

BACKGROUND OF THE INVENTION (1) Field of the Invention

The present invention relates to a centrifugal compressor, and in particular to a dry gas seal system thereof.

(2) Description of Related Art

Examples of conventional dry gas seal systems for use in a centrifugal compressor are disclosed in JP-A-9-60734, WO 01/007791 A1, and JP-A-11-182690. In the dry gas seal system disclosed in JP-A-9-60734, to collect process gas leaked from a temporary seal of a dry gas seal for preventing environmental contamination, and to save resources, a small-sized compressor is installed to a leak gas line of the process gas leaked from the temporary seal of the dry gas seal. Furthermore, a cushion tank keeping a pressure balance is installed on a suction side of the small-sized compressor. The process gas whose pressure is increased is returned to a process gas line by the small-sized compressor.

The dry gas seal system disclosed in WO 01/007791 A1 is equipped with a primary dry gas seal and a secondary dry gas seal. The working gas leaked between a rotor and a rotary ring is detected by a pressure switch and a flow meter installed in a primary seal ventilation line. The working gas leaked from a labyrinth seal and the secondary dry gas seal is exhausted to the outside of a machine together with a purge gas.

The dry gas seal system disclosed in JP-A-11-182690 handles volatile fluid. A drain hole is provided between a mechanical seal and a dry seal, and a collection pipe is connected with the drain hole. The collected fluid is overheated and evaporated by a steam pipe, introduced to a flare, and treated by combustion.

BRIEF SUMMARY OF THE INVENTION

Each of the above-cited documents discloses reduction of a leak gas volume using the dry gas seal. When abnormality such as breakage of seal means occurs, a check valve is actuated, so as to prevent pressure increase generated on a downstream side of the dry gas seal.

However, because the pipe on the downstream side of the check valve is mostly communicated with the pipe supplied to other facilities, pressure fluctuation caused in the other facilities might be propagated to the check valve on an upstream side through the pipe. The check valve requires a limited time till closure, and cannot cope with a rapid pressure increase. As a result, abnormal pressure generated on the downstream side of the dry gas seal is propagated to the dry gas seal, and a back flow is generated inside the dry gas seal, so that the dry gas seal might be broken. Also, the back flow generated by the generated pressure increase improper actuates a flow meter monitoring deterioration of a performance of the dry gas seal, and causes a frequent action of alarm/shut-down, so that a life of a centrifugal compressor might be reduced. WO 01/007791 A1, and JP-A-11-182690 do not describe avoidance of such failures.

To solve such failures, the method disclosed in JP-A-9-60734 for collecting the leak gas by installing the leak gas tank on the downstream side of the check valve can prevent influences on the downstream side from reaching the seal means. However, a new facility for processing the collected leak gas is required, so that an apparatus including auxiliary machines is enlarged and costs are increased.

The present invention is made in view of the above-mentioned failures of the prior arts, and an object of the present invention is to protect seal means in dry gas sealing. Another object of the present invention is to avoid an unnecessary stop of operation of a centrifugal compressor.

In an aspect of the present invention for achieving the above-mentioned objects, a multistage centrifugal compressor has primary dry gas seal means for preventing leakage of working gas from a machine inner side, and secondary dry gas seal means for backing up the first dry gas seal means. A seal gas line for introducing the gas leaked from the first and second dry gas seal means to the outside of the machine is installed between the primary dry gas seal means and the secondary dry gas seal means, and has an orifice and a check valve. Buffer means is installed between the orifice and the check valve.

In this aspect, the buffer means may be preferably an accumulator, and the centrifugal compressor may be a uniaxial multistage compressor, in which a plurality of centrifugal impellers are mounted to the same shaft.

In another aspect of the present invention for achieving the above-mentioned objects, the dry gas seal system is used for a multistage centrifugal compressor, and introduces the leak gas leaked from the machine to the outside of the machine. The dry gas system has dry seal means arranged in the machine, a channel for introducing the leak gas leaked from the dry seal means, two flow meters continuously arranged in the downstream side of the channel, restriction means arranged on the downstream side of the two flow meters, buffer means arranged on the downstream side of the restriction means, and a check valve arranged on the downstream side of the buffer means.

In this aspect, it is desirable that the restriction means is an orifice and the buffer means is an accumulator.

According to the present invention, the buffer means capable of absorbing influences on the downstream side is installed to a primary dry seal line for introducing the leak gas from the seal means, so that influences on the seal means by the influences on the downstream side can be reduced and the seal means can be protected. Also, the improper actuation of the flow meter installed on the upstream side of the orifice and detecting deterioration of the seal means can be prevented, and an unnecessary stop of operation of the centrifugal compressor can be avoided.

Other objects, features and advantages of the invention will become apparent from the following description of the embodiments of the invention taken in conjunction with the accompanying drawings.

DETAILED DESCRIPTION OF THE INVENTION

Figure 1:
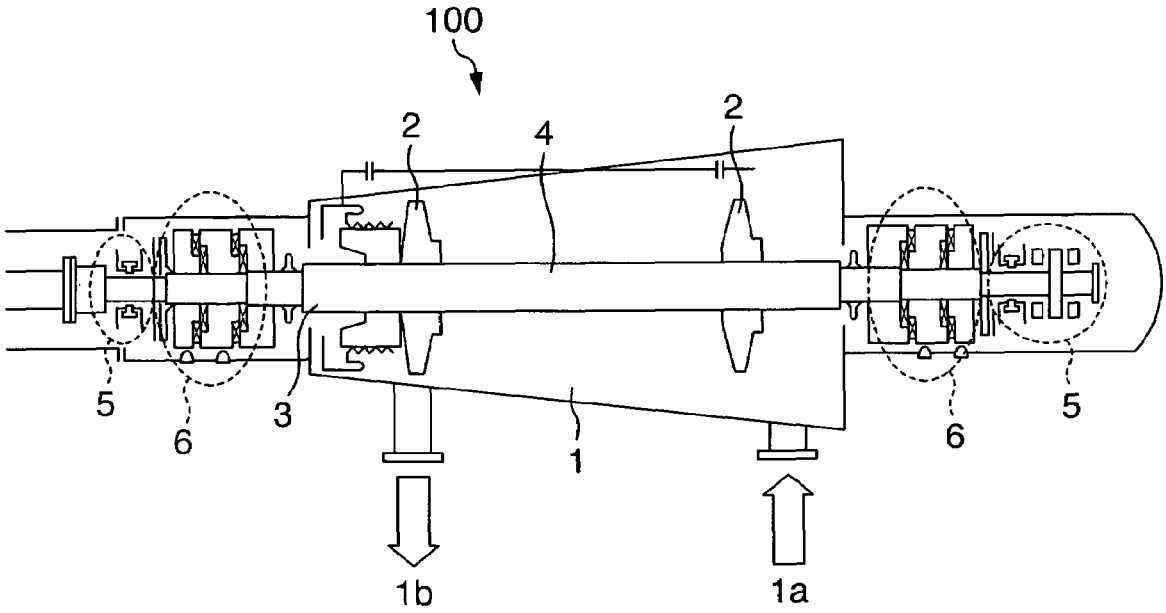
FIG. 1 is a block diagram of one embodiment of a centrifugal compressor according to the present invention.

Now, one embodiment of a multistage centrifugal compressor according to the present invention and a dry seal system used for it will be explained. FIG. 1 diagrammatically shows a multistage centrifugal compressor 100. In a uniaxial multistage centrifugal compressor handling process gas such as ethylene gas, a plurality of centrifugal impellers 2 are mounted to a rotary shaft 3. A rotor 4 is formed integrally by the rotary shaft 3 and the centrifugal impellers 2. The rotor 4 is supported radially and axially by bearings 5 installed on both of axial ends of the rotary shaft 3. The rotor 4 and the bearings 5 are housed in a casing 1. The bearings 5 comprise journal bearings rotatably supporting the rotary shaft 3 in the radial direction, and a thrust bearing restraining the axial movement of the rotary shaft 3. In FIG. 1, the journal bearing is installed on a left axial end, and the thrust bearing and the journal bearing are installed on a right axial end.

Seal means 6 are installed on a machine inner side of each of the bearings 5, to prevent the working gas inside the centrifugal compressor 100 from flowing toward the bearings 5. The casing 1 extends to the axial end of the rotary shaft 3 beyond the centrifugal impellers 2 to cover the seal means 6 and the bearings 5. Thereby, the working gas is prevented from leaking to the outside of the machine.

The working gas of the centrifugal compressor 100 is sucked from a suction port 1*a* formed on the casing 1, and compressed by the centrifugal impellers 2 together with the rotation of the rotor 4, so as to reduce its volume. The working gas compressed by the centrifugal impellers 2 is sequentially transferred to the centrifugal impellers 2 on the rear stage side (left side in FIG. 1) through diffusers and a return channel (not shown). After the working gas passes through the diffuser on a final stage, it is transferred to a demand source as emission gas from an emission port 1*b* formed on the casing 1.

Figure 2:
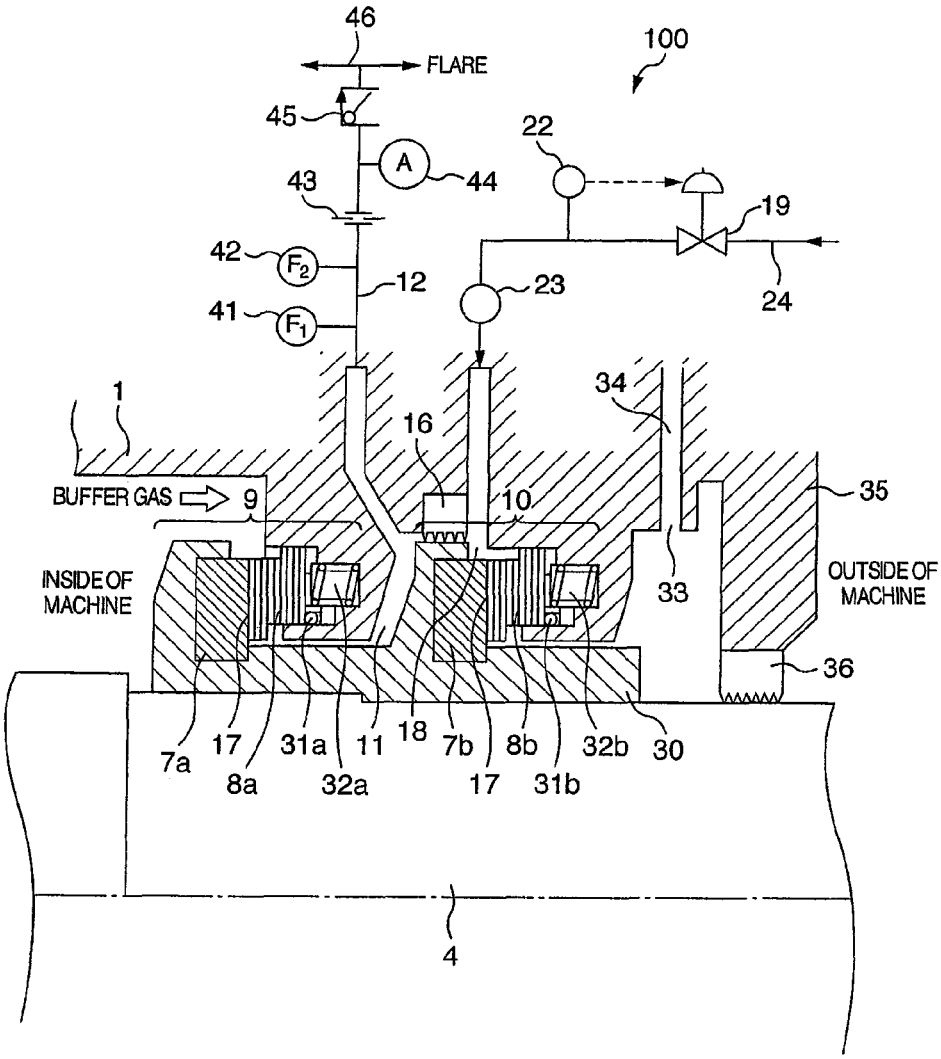
FIG. 2 is a schematic view of a dry gas seal used for a centrifugal compressor shown in FIG. 1.

Details of thus formed seal means 6 of the centrifugal compressor 100 is shown in a vertical sectional view of FIG. 2. FIG. 2 shows the details of the right seal means 6 provided to the centrifugal compressor 100 shown in FIG. 1. The left seal means 6 is constituted approximately symmetrical to the right seal means 6. In this embodiment, the seal means is a dry gas seal. The dry gas seal has a primary dry gas seal 9 located on a machine central side of the centrifugal compressor 100, and a secondary dry gas seal 10 located nearer the bearing 5 than the primary dry gas seal 9.

Both of the primary dry gas seal 9 and the secondary dry gas seal 10 have rotary rings 7*a*, 7*b* held to a holding member 30 mounted to the rotor 4, and stationary rings 8*a*, 8*b* coming into contact with the rotary rings 7*a*, 7*b* to form sealing faces 17. The rotary rings 7*a*, 7*b* rotate together with the rotor 4. Springs 32*a*, 32*b* are located on the back sides of the stationary rings 8*a*, 8*b*, so as to control sealing between the stationary rings 8*a*, 8*b* and the rotary rings 7*a*, 7*b*.

O-rings 31*a*, 31*b* for preventing the working gas from leaking in an axial direction from spacings formed between the stationary rings 7*a*, 7*b* and the casing 1 are located on the inner peripheral sides of the stationary rings 8*a*, 8*b*. A spacing is formed between the inner periphery of the casing 1 and the holding member 30, into which the working gas leaked from the sealing surface of the rotary ring 7*a* and the stationary ring 8*a* is introduced. The leak gas flown in the spacing flows in a space 18 formed in the casing 1, and flows to the outside of the machine from a primary dry gas seal line 12 communicated with the space 18.

Similarly, a spacing is also formed between the inner periphery of the casing 1 and the holding member 30 on the side of the secondary dry gas seal 10, into which some of the working gas and the purge gas leaked between the rotary ring 7*b* and the stationary ring 8*b* is introduced. The leak gas flows in an external channel 34 via a room 33 formed between the secondary dry gas seal 10 and a holder 35 of the bearing 5 from the spacing, and then flows to the outside of the machine.

The secondary dry gas seal 10 acts as a backup of the primary dry gas seal 9. When the primary dry gas seal 9 does not function, the secondary dry gas seal 10 actuates. However, under a condition that the secondary dry gas seal 10 actuates, the compressor is quickly stopped, so that the secondary dry gas seal 10 is not equipped with a piping system like the primary dry gas seal line 12.

Some of the working gas leaked from the primary dry gas seal 9 flows in a space 18 formed on the back side of a labyrinth 16 via the labyrinth 16 arranged nearer an axial end side than the channel 11. The purge gas is supplied from a purge gas line 24 to the space 18. The pressure of the purge gas is set slightly higher than the pressure of the working gas flowing in the primary dry gas seal line 12.

Also, a control valve 19 for controlling a volume of the purge gas flowing in the purge gas line, a flow rate switch 23 interposed in the middle between the control valve 19 and the space 18, and pressure detection means 22 are arranged in the purge gas line 24. The control valve 19 is controlled, so that the pressure detected by the pressure detection means 22 becomes constant. The gas identical to the working gas, and nitrogen gas, air and the like kept in a stable condition are used for the purge gas.

The primary dry gas seal line 12 is communicated with the channel 11 formed between the primary dry gas seal 9 and the secondary dry gas seal 10 on the machine outside, and has two flow meters 41, 42 continuously arranged in a flow direction, an orifice 43 installed on the downstream side of the flow meters 41, 42, an accumulator 44 installed on the downstream side of the orifice 43, and a check valve 45 installed on the downstream side of the accumulator 44. Thereafter, some of the gas is introduced to a flare line 46, and the other is released to the atmosphere or introduced to the line 47 of leak gas processing means (not shown).

In this manner, according to the present invention, two flow meters 41, 42 are continuously installed to the primary dry gas seal line 12. When the dry gas seal 9 is broken and the volume of the leak gas is increased, a flow rate detected by the two flow meters 41, 42 installed to the dry gas seal line 12 is increased, so that abnormality can be detected at an early stage. When abnormality is detected, a control device (not shown) commands instruction of alarm/shut-down.

During the operation of the compressor, when a pressure is rapidly increased on the downstream side of the check valve 45, the pressure is propagated to the upstream side till the check valve 45 is closed. The orifice 43 is approximately under a closed condition, so that the pressure is increased only between the check valve 45 and the orifice 43. Here, the accumulator 44 is arranged to the primary dry gas seal line 12, so that the accumulator 44 can absorb the pressure increase between the check valve 45 and the orifice 43. As a result, the pressure increase generated on the downstream side of the orifice 43 can be prevented from being propagated to the upstream side of the orifice 43.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A multistage centrifugal compressor, comprising a dry gas seal arrangement configured to prevent leakage of working gas from a machine inner side, a secondary dry gas seal arrangement configured to back up the primary dry gas seal arrangement, a seal gas line operatively arranged between the primary and secondary dry gas seal arrangements for introducing the gas leaked from the primary and secondary dry gas seal arrangements, wherein the seal gas line has an orifice and a check valve, and an accumulator is installed in series between the orifice and the check valve, the accumulator being configured and arranged to contain the gas that has back-flowed from the outside to the check valve and to prevent, previous to the check valve being completely closed due to a back-pressure increase, the back-flowed gas contained therein from flowing into the sealing arrangements.

2. The centrifugal compressor according to claim 1, wherein said centrifugal compressor is a uniaxial multistage compressor, in which a plurality of centrifugal impellers are mounted to a common shaft.

3. A dry gas seal system used for a multistage centrifugal compressor and introducing leak gas leaked from a machine to an outside of the machine, comprising a dry seal arrangement in the machine, a channel for introducing the gas leaked from the dry seal means, two flow meters continuously arranged in a downstream side of the channel, a restrictor arranged on a downstream side of the two flow meters, an accumulator arranged on a downstream side of the restrictor, and a check valve arranged on a downstream side of the accumulator which is arranged in series between the restrictor and the check valve, the accumulator being configured and arranged to contain the gas that has back-flowed from the outside to the check valve and to prevent by the gas contained therein so that previous to the check valve being completely closed due to a back-pressure increase, the back-flowed gas contained therein is prevented from flowing into the sealing arrangement.

4. The dry gas seal system according to claim 3, wherein said restrictor is an orifice.

* * * * *